US007380731B1

(12) United States Patent
Hsu

(10) Patent No.: US 7,380,731 B1
(45) Date of Patent: Jun. 3, 2008

(54) WATER SPRAYER HAVING TWO WATER DIFFERENT SPRAYING MODES

(75) Inventor: Ming-Yuan Hsu, Lugang Town (TW)

(73) Assignee: Da Yuan Sheng Industrial Co., Ltd., Changhua County (TW)

( * ) Notice: Subject to any disclaimer, the term of this patent is extended or adjusted under 35 U.S.C. 154(b) by 2 days.

(21) Appl. No.: 11/520,256

(22) Filed: Sep. 13, 2006

(51) Int. Cl.
*A62C 31/00* (2006.01)

(52) U.S. Cl. ..... 239/447; 239/443; 239/449; 239/391; 239/525; 239/440; 239/530

(58) Field of Classification Search ..... 239/589, 239/583, 548, 436, 438, 459, 440–449, 451, 239/526, 381, 562
See application file for complete search history.

(56) References Cited

U.S. PATENT DOCUMENTS 2,670,942 A * 3/1954 Aghnides ..... 239/391
2,944,743 A * 7/1960 Kachergis ..... 239/458
4,618,100 A * 10/1986 White et al. ..... 239/440
4,703,893 A * 11/1987 Gruber ..... 239/391
4,838,486 A * 6/1989 Finkbeiner ..... 239/117
5,069,241 A * 12/1991 Hochstrasser ..... 137/119.05
5,433,384 A * 7/1995 Chan et al. ..... 239/449
5,704,397 A * 1/1998 Lu ..... 137/630.15
6,370,713 B2 * 4/2002 Bosio ..... 4/677
6,622,945 B1 * 9/2003 Wu et al. ..... 239/443
6,738,996 B1 * 5/2004 Malek et al. ..... 4/677
7,303,151 B2 * 12/2007 Wu ..... 239/447
2004/0112985 A1 * 6/2004 Malek et al. ..... 239/445

* cited by examiner

*Primary Examiner*—Dinh Q. Nguyen
*Assistant Examiner*—Trevor McGraw
(74) *Attorney, Agent, or Firm*—Alan Kamrath; Kamrath & Associates PA

(57) ABSTRACT

A water sprayer includes a housing, a control valve, a valve seat, a nozzle unit, a valve shaft, and a control button. Thus, the first nozzle and the second nozzle of the nozzle unit provide two different water spraying modes so that the water is injected outwardly from the nozzle unit in two different spraying modes according to a user's requirements, thereby enhancing the versatility of the water sprayer. In addition, the water sprayer is switched between two different spraying modes by pressing of the control button, thereby facilitating the user operating the water sprayer.

19 Claims, 6 Drawing Sheets

WATER SPRAYER HAVING TWO WATER DIFFERENT SPRAYING MODES

BACKGROUND OF THE INVENTION

1. Field of the Invention

The present invention relates to a water sprayer and, more particularly, to a water sprayer that is mounted on the spout of a faucet, the outlet end of a water pipe or the like.

2. Description of the Related Art

A conventional faucet comprises a spout to inject water outward for use with a user. However, the spout of the faucet only has a single water output manner, so that the water is injected outward from the spout of the faucet in a stronger manner with a smaller area, thereby decreasing the working efficiency and wasting the water resource.

BRIEF SUMMARY OF THE INVENTION

The primary objective of the present invention is to provide a water sprayer having a flow channel switching function to provide two different spraying modes.

Another objective of the present invention is to provide a water sprayer, wherein the first nozzle and the second nozzle of the nozzle unit provide two different water spraying modes so that the water is injected outwardly from the nozzle unit in two different spraying modes according to a user's different requirements, thereby enhancing the versatility of the water sprayer.

A further objective of the present invention is to provide a water sprayer, wherein the water flow is injected outwardly from the nozzle unit in a stronger or weaker manner and with a larger or smaller area, thereby enhancing the working efficiency of the water sprayer and saving the water resource.

A further objective of the present invention is to provide a water sprayer, wherein the water sprayer is switched between two different spraying modes by pressing of the control button, thereby facilitating the user operating the water sprayer.

A further objective of the present invention is to provide a water sprayer, wherein the water pressure from the water inlet channel of the control valve overcomes the elastic force of the restoring spring, so that the water flow from the water inlet channel of the control valve is injected outwardly from the second nozzle of the nozzle unit constantly even after the control button is released, and the user needs not to press the control button constantly, thereby facilitating the user operating the water sprayer.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
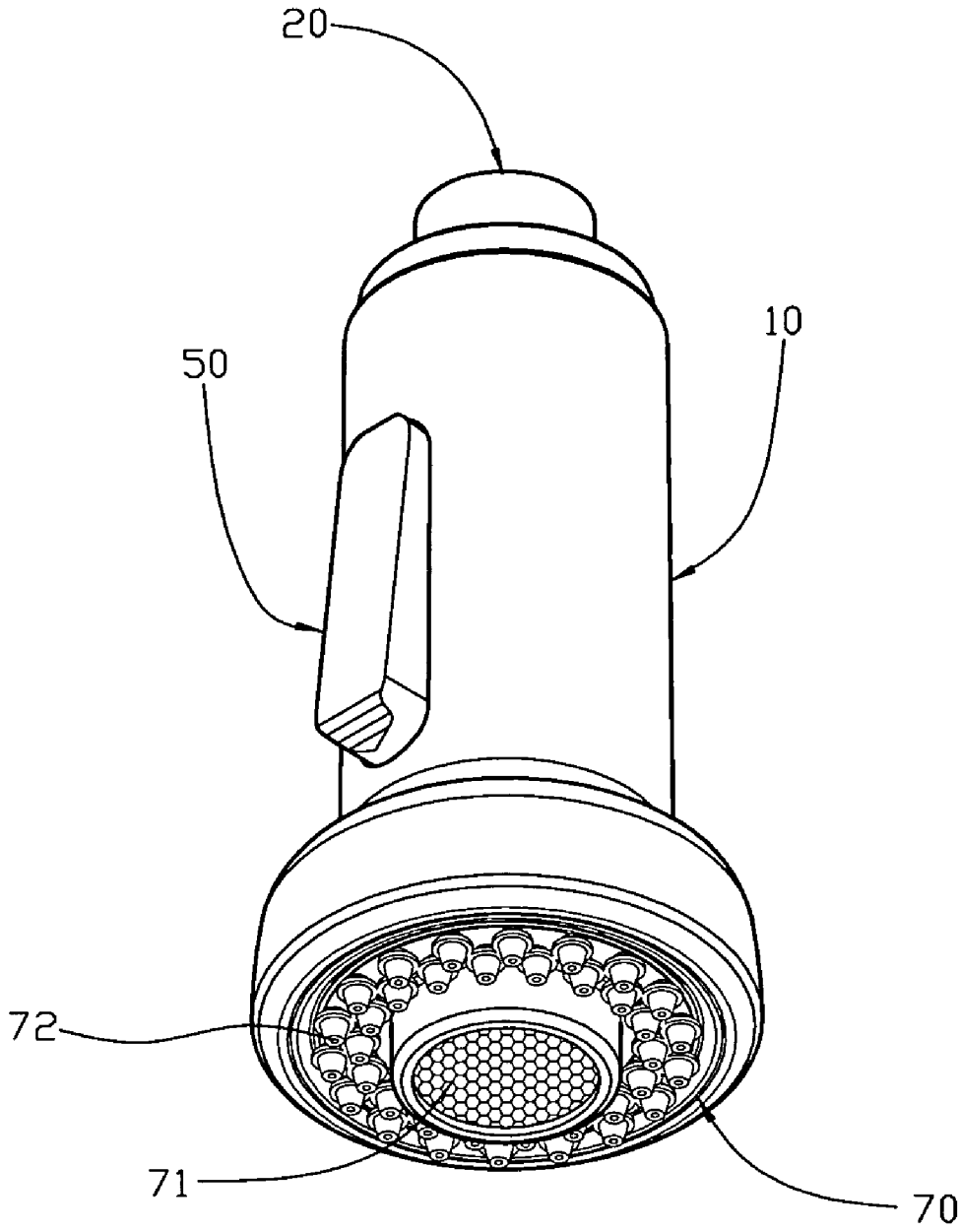
FIG. 1 is a perspective view of a water sprayer in accordance with the preferred embodiment of the present invention.
Figure 2:
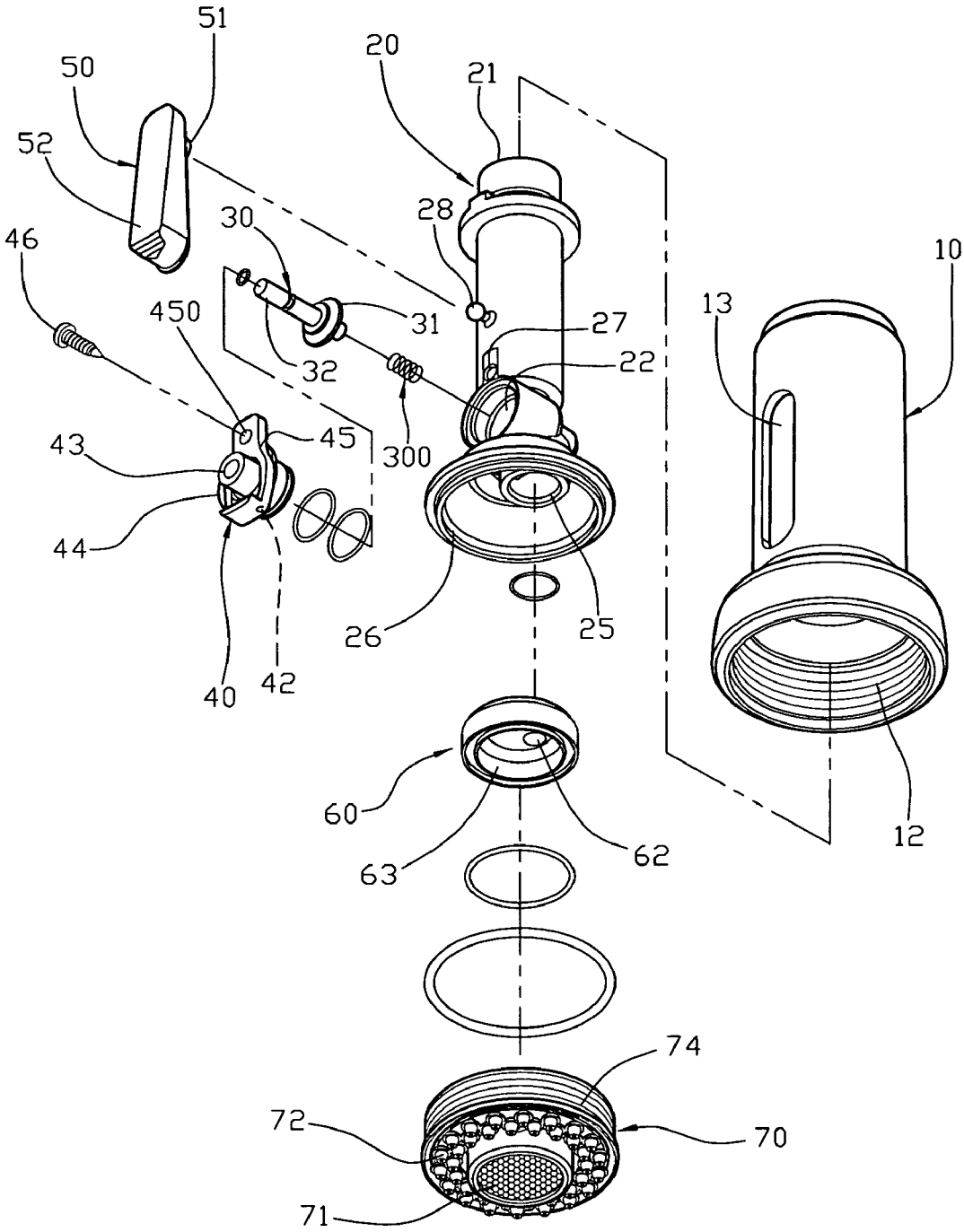
FIG. 2 is an exploded perspective view of the water sprayer as shown in FIG. 1.
Figure 3:
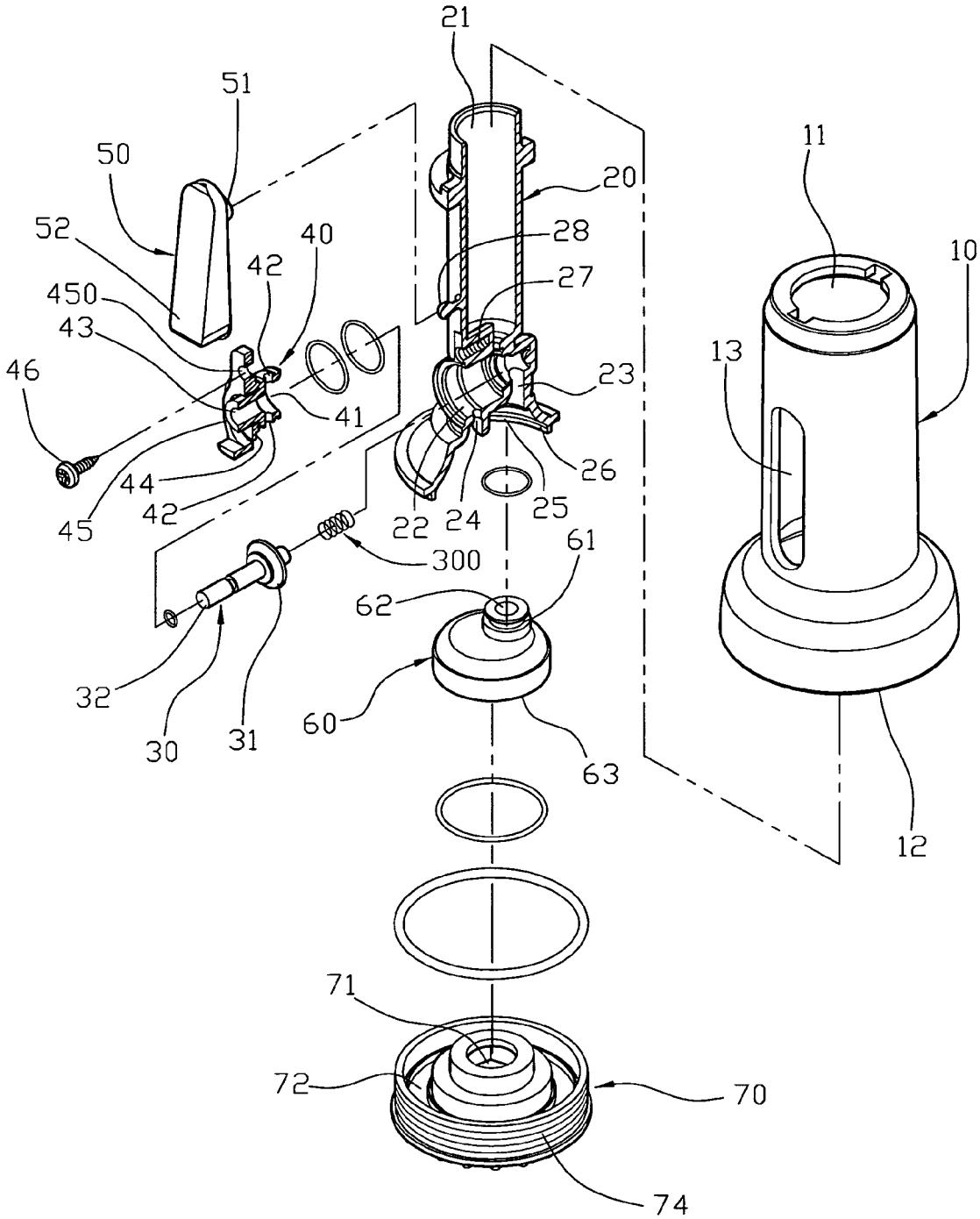
FIG. 3 is another exploded perspective view of the water sprayer as shown in FIG. 1.
Figure 4:
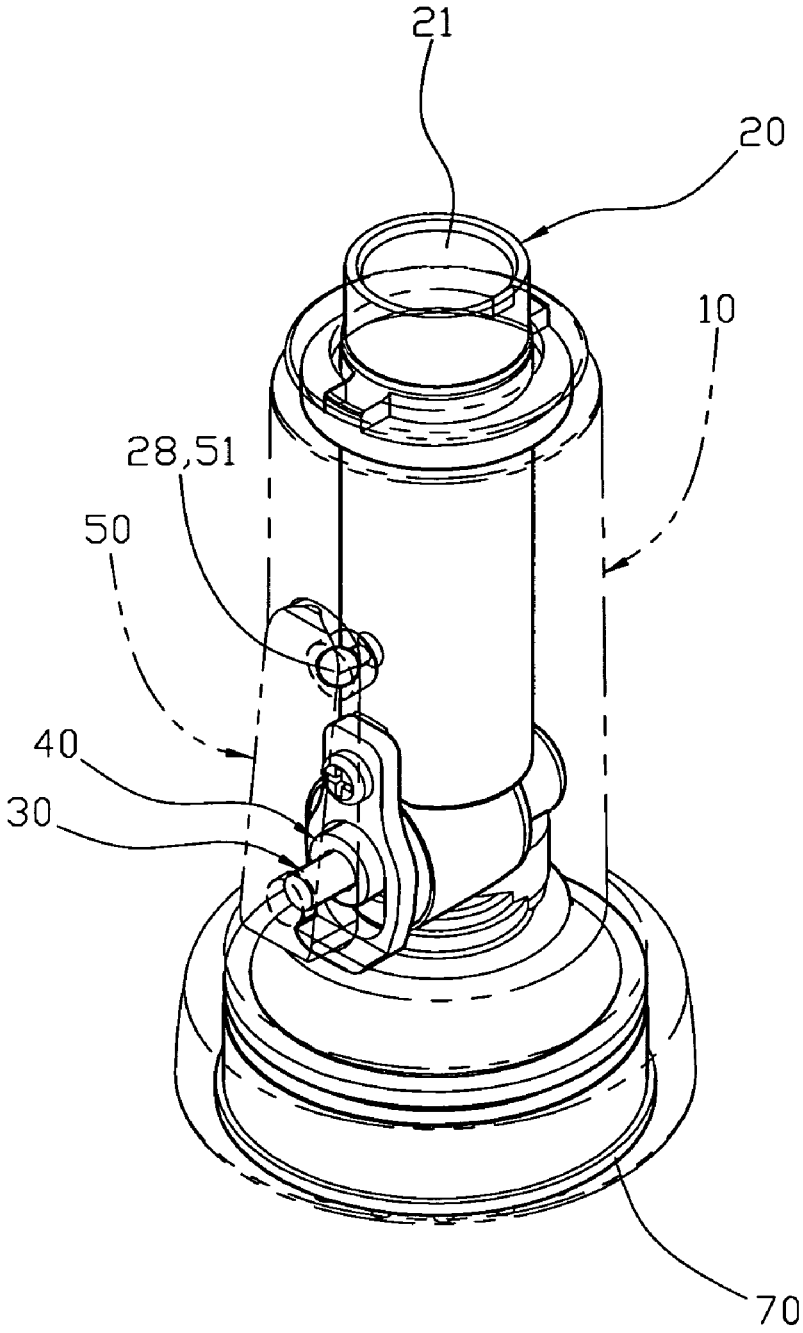
FIG. 4 is another perspective view of the water sprayer as shown in FIG. 1.

Referring to the drawings and initially to FIGS. 1-5, a water sprayer in accordance with the preferred embodiment of the present invention comprises a housing 10, a control valve 20 mounted in a first end of the housing 10 and having an inside formed with a water inlet channel 21 which has a first end protruded outwardly from the housing 10 and a second end provided with a valve chamber 22 which has a first side formed with a first water conduit 23 connected to the water inlet channel 21 and a second water conduit 24 connected to the water inlet channel 21, a valve seat 40 mounted in the valve chamber 22 of the control valve 20 and having a side formed with a water inlet hole 41 connected to the water inlet channel 21 of the control valve 20 and a peripheral wall formed with a water outlet hole 42 connected to the water inlet hole 41 and the second water conduit 24 of the valve chamber 22, a nozzle unit 70 mounted in a second end of the housing 10 and having a first nozzle 71 connected to the first water conduit 23 of the valve chamber 22 and a second nozzle 72 connected to the second water conduit 24 of the valve chamber 22, a valve shaft 30 movably mounted in the valve seat 40 and having a first end provided with a dividing disk 31 movable in the valve chamber 22 of the control valve 20 and located between the first water conduit 23 of the valve chamber 22 and the water inlet hole 41 of the valve seat 40 and a second end 32 protruded outwardly from the housing 10, and a control button 50 pivotally mounted on the housing 10 and rested on the second end 32 of the valve shaft 30 to control movement of the valve shaft 30.

Figure 5:
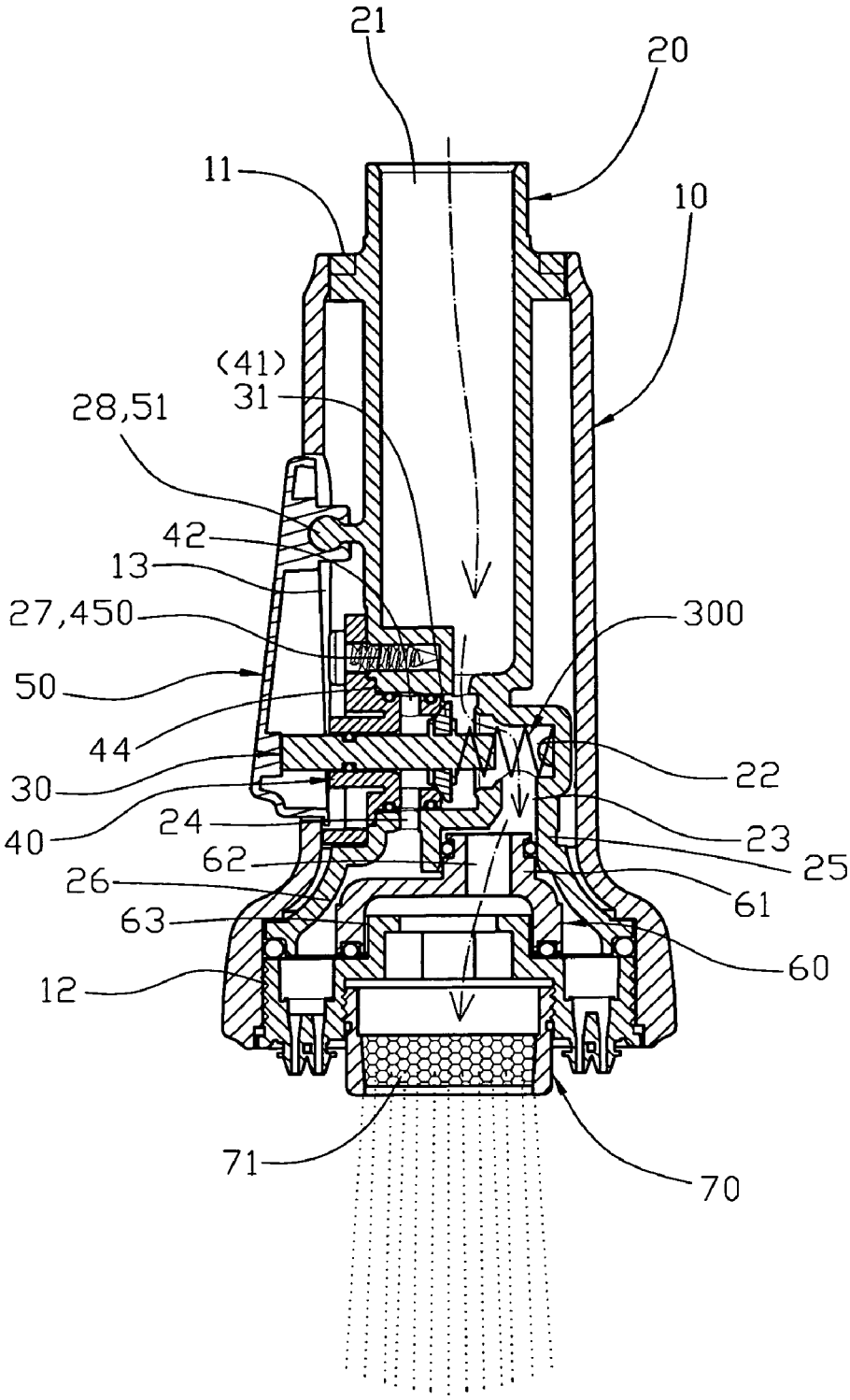
FIG. 5 is a plan cross-sectional view of the water sprayer as shown in FIG. 1.
Figure 6:
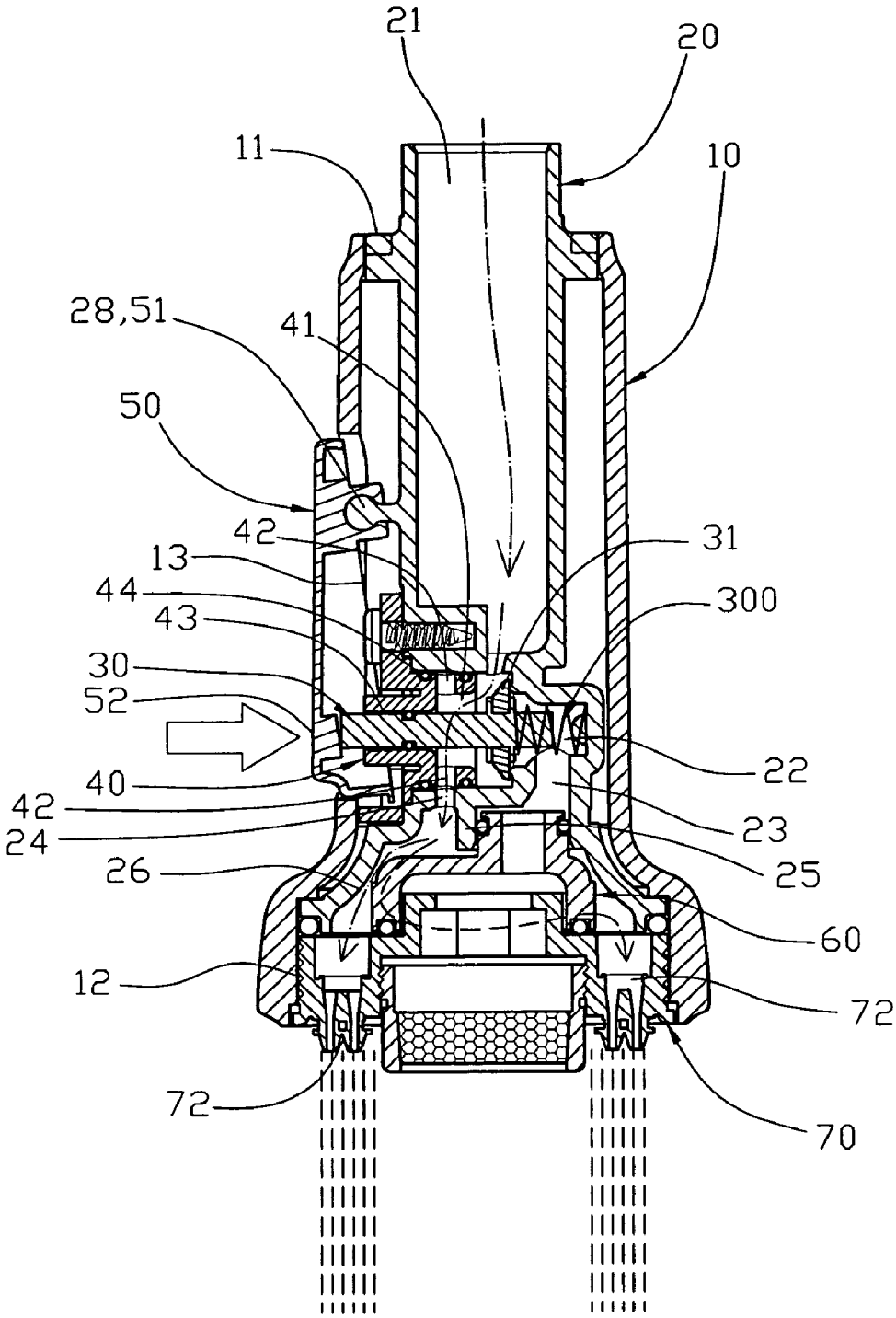
FIG. 6 is a schematic operational view of the water sprayer as shown in FIG. 5.

Thus, the valve shaft 30 is movable between a first position as shown in FIG. 5 where the dividing disk 31 of the valve shaft 30 opens a connection between the first water conduit 23 of the valve chamber 22 and the water inlet channel 21 of the control valve 20 and closes a connection between the water inlet hole 41 of the valve seat 40 and the water inlet channel 21 of the control valve 20 so that water from the water inlet channel 21 of the control valve 20 in turn flows through the first water conduit 23 of the valve chamber 22 into the first nozzle 71 of the nozzle unit 70 and is injected outward from the first nozzle 71 of the nozzle unit 70, and a second position as shown in FIG. 6 where the dividing disk 31 of the valve shaft 30 opens the connection between the water inlet hole 41 of the valve seat 40 and the water inlet channel 21 of the control valve 20 and closes the connection between the first water conduit 23 of the valve chamber 22 and the water inlet channel 21 of the control valve 20 so that the water from the water inlet channel 21 of the control valve 20 in turn flows through the water inlet hole 41 and the water outlet hole 42 of the valve seat 40 and the second water conduit 24 of the valve chamber 22 into the second nozzle 72 of the nozzle unit 70 and is injected outward from the second nozzle 72 of the nozzle unit 70.

The housing 10 has a peripheral wall formed with an elongated slot 13 to receive the control button 50. The first end of the housing 10 is formed with a stepped through hole 11 to retain the control valve 20, and the second end of the housing 10 is formed with an inner thread 12.

The control valve 20 has a peripheral wall formed with a screw bore 27 and a substantially spherical pivot base 28 each located above the valve chamber 22. The control valve 20 has an end portion formed with an inner enclosure 25 located under the valve chamber 22 and connected to the first water conduit 23 of the valve chamber 22 and an outer enclosure 26 located under the valve chamber 22 and connected to the second water conduit 24 of the valve chamber 22. The valve chamber 22 of the control valve 20 is extended in a direction perpendicular to an axial direction of the control valve 20 and has a mediate portion connected to the water inlet channel 21 of the control valve 20.

The valve seat 40 has an inside formed with a shaft hole 43 to allow passage of the valve shaft 30. The water inlet hole 41 of the valve seat 40 is spaced from the first water conduit 23 of the valve chamber 22 and connected to the shaft hole 43. The valve seat 40 has a peripheral wall formed with an annular seal portion 44 rested on an open outer side of the valve chamber 22 of the control valve 20 to seal the valve chamber 22 of the control valve 20. The peripheral wall of the valve seat 40 is formed with a protruding extension plate 45 formed with a through hole 450, and a locking screw 46 is extended through the through hole 450 of the valve seat 40 and screwed into the screw bore 27 of the control valve 20 to attach the valve seat 40 to the control valve 20.

The control button 50 has a first end formed with a substantially spherical pivot recess 51 pivotally mounted on the pivot base 28 of the control valve 20 and a second end formed with a press portion 52 rested on the second end 32 of the valve shaft 30.

The nozzle unit 70 has an outer thread 74 screwed into the inner thread 12 of the housing 10. The second nozzle 72 of the nozzle unit 70 is enclosed around and located outside of the first nozzle 71 so that and the first nozzle 71 and the second nozzle 72 of the nozzle unit 70 provide two different water output manners.

The water sprayer further comprises a mounting sleeve 60 mounted between the control valve 20 and the nozzle unit 70 and connected between the first water conduit 23 of the valve chamber 22 and the first nozzle 71 of the nozzle unit 70. The mounting sleeve 60 is received in the outer enclosure 26 of the control valve 20 and has an inside formed with a mounting hole 63 mounted on and connected to the first nozzle 71 of the nozzle unit 70 and has a top wall formed with a protruding mounting portion 61 inserted into the inner enclosure 25 of the control valve 20. The mounting portion 61 of the mounting sleeve 60 has an inside formed with a connecting hole 62 connected to the mounting hole 63 and the first water conduit 23 of the valve chamber 22.

The water sprayer further comprises a restoring spring 300 mounted on the valve shaft 30 and biased between the dividing disk 31 of the valve shaft 30 and the first side of the valve chamber 22 of the control valve 20 to push the dividing disk 31 of the valve shaft 30 toward the valve seat 40 to open the connection between the first water conduit 23 of the valve chamber 22 and the water inlet channel 21 of the control valve 20 and to close the connection between the water inlet hole 41 of the valve seat 40 and the water inlet channel 21 of the control valve 20 as shown in FIG. 5.

When in use, referring to FIGS. 1-6, the water sprayer is mounted on the spout of a faucet or the outlet end of a water pipe to allow the water flowing into the water inlet channel 21 of the control valve 20. Then, the water from the water inlet channel 21 of the control valve 20 flows into the valve chamber 22 of the control valve 20.

As shown in FIG. 5, the restoring spring 300 pushes the dividing disk 31 of the valve shaft 30 toward the valve seat 40 to open the connection between the first water conduit 23 of the valve chamber 22 and the water inlet channel 21 of the control valve 20 and to close the connection between the water inlet hole 41 of the valve seat 40 and the water inlet channel 21 of the control valve 20, so that the water from the valve chamber 22 of the control valve 20 in turn flows through the first water conduit 23 of the valve chamber 22, the connecting hole 62 of the mounting portion 61 and the mounting hole 63 of the mounting sleeve 60 into the first nozzle 71 of the nozzle unit 70 and is injected outward from the first nozzle 71 of the nozzle unit 70. Thus, the water injected outward from the first nozzle 71 of the nozzle unit 70 is concentrated to have a greater strength and a smaller spraying area.

As shown in FIG. 6, when the valve shaft 30 is movable toward the valve chamber 22 of the control valve 20 by pressing of the control button 50, the restoring spring 300 is compressed, and the dividing disk 31 of the valve shaft 30 is movable toward the first water conduit 23 of the valve chamber 22 to open the connection between the water inlet hole 41 of the valve seat 40 and the water inlet channel 21 of the control valve 20 and to close the connection between the first water conduit 23 of the valve chamber 22 and the water inlet channel 21 of the control valve 20, so that the water from the water inlet channel 21 of the control valve 20 in turn flows through the water inlet hole 41 and the water outlet hole 42 of the valve seat 40 and the second water conduit 24 of the valve chamber 22 into the second nozzle 72 of the nozzle unit 70 and is injected outward from the second nozzle 72 of the nozzle unit 70. Thus, the water injected outward from the second nozzle 72 of the nozzle unit 70 is diffused to have a smaller strength and a larger spraying area.

At this time, the water pressure from the water inlet channel 21 of the control valve 20 overcomes the elastic force of the restoring spring 300, so that the water flow from the water inlet channel 21 of the control valve 20 is injected outwardly from the second nozzle 72 of the nozzle unit 70 constantly even after the control button 50 is released.

After the water flow from the water inlet channel 21 of the control valve 20 is closed, the valve shaft 30 is pushed by the restoring force of the restoring spring 300 to move toward the valve seat 40 to open the connection between the first water conduit 23 of the valve chamber 22 and the water inlet channel 21 of the control valve 20 and to close the connection between the water inlet hole 41 of the valve seat 40 and the water inlet channel 21 of the control valve 20 for use with the user at the next time.

Accordingly, the first nozzle 71 and the second nozzle 72 of the nozzle unit 70 provide two different water spraying modes so that the water is injected outwardly from the nozzle unit 70 in two different spraying modes according to a user's different requirements, thereby enhancing the versatility of the water sprayer. In addition, the water flow is injected outwardly from the nozzle unit 70 in a stronger or weaker manner and with a larger or smaller area, thereby enhancing the working efficiency of the water sprayer and saving the water resource. Further, the water sprayer is switched between two different spraying modes by pressing of the control button 50, thereby facilitating the user operating the water sprayer. Further, the water pressure from the water inlet channel 21 of the control valve 20 overcomes the elastic force of the restoring spring 300, so that the water flow from the water inlet channel 21 of the control valve 20 is injected outwardly from the second nozzle 72 of the nozzle unit 70 constantly even after the control button 50 is released, and the user needs not to press the control button 50 constantly, thereby facilitating the user operating the water sprayer.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A water sprayer, comprising:

a housing;

a control valve mounted in a first end of the housing and having an inside formed with a water inlet channel which has a first end protruded outwardly from the housing and a second end provided with a valve chamber which has a first side formed with a first water conduit connected to the water inlet channel and a second water conduit connected to the water inlet channel;

a valve seat mounted in the valve chamber of the control valve and having a side formed with a water inlet hole connected to the water inlet channel of the control valve and a peripheral wall formed with a water outlet hole connected to the water inlet hole and the second water conduit of the valve chamber;

a nozzle unit mounted in a second end of the housing and having a first nozzle connected to the first water conduit of the valve chamber and a second nozzle connected to the second water conduit of the valve chamber;

a valve shaft movably mounted in the valve seat and having a first end provided with a dividing disk movable in the valve chamber of the control valve and located between the first water conduit of the valve chamber and the water inlet hole of the valve seat and a second end protruded outwardly from the housing;

a control button pivotally mounted on the housing and rested on the second end of the valve shaft to control movement of the valve shaft;

wherein the control valve has a peripheral wall formed with a screw bore, the valve seat has a peripheral wall formed with a protruding extension plate formed with a through hole, and the water sprayer further comprises a locking screw extended through the through hole of the valve seat and screwed into the screw bore of the control valve to attach the valve seat to the control valve.

2. The water sprayer in accordance with claim 1, wherein the valve shaft is movable between a first position where the dividing disk of the valve shaft opens a connection between the first water conduit of the valve chamber and the water inlet channel of the control valve and closes a connection between the water inlet hole of the valve seat and the water inlet channel of the control valve so that water from the water inlet channel of the control valve in turn flows through the first water conduit of the valve chamber into the first nozzle of the nozzle unit and is injected outward from the first nozzle of the nozzle unit, and a second position where the dividing disk of the valve shaft opens the connection between the water inlet hole of the valve seat and the water inlet channel of the control valve and closes the connection between the first water conduit of the valve chamber and the water inlet channel of the control valve so that the water from the water inlet channel of the control valve in turn flows through the water inlet hole and the water outlet hole of the valve seat and the second water conduit of the valve chamber into the second nozzle of the nozzle unit and is injected outward from the second nozzle of the nozzle unit.

3. The water sprayer in accordance with claim 2, wherein the control valve has an end portion formed with an inner enclosure located under the valve chamber and connected to the first water conduit of the valve chamber and an outer enclosure located under the valve chamber and connected to the second water conduit of the valve chamber.

4. The water sprayer in accordance with claim 3, further comprising a mounting sleeve mounted between the control valve and the nozzle unit and connected between the first water conduit of the valve chamber and the first nozzle of the nozzle unit.

5. The water sprayer in accordance with claim 4, wherein the mounting sleeve is received in the outer enclosure of the control valve and has an inside formed with a mounting hole mounted on and connected to the first nozzle of the nozzle unit and a top wall formed with a protruding mounting portion inserted into the inner enclosure of the control valve.

6. The water sprayer in accordance with claim 5, wherein the mounting portion of the mounting sleeve has an inside formed with a connecting hole connected to the mounting hole and the first water conduit of the valve chamber.

7. The water sprayer in accordance with claim 6, wherein when the valve shaft is movable to the first position, the water from the valve chamber of the control valve in turn flows through the first water conduit of the valve chamber, the connecting hole of the mounting portion and the mounting hole of the mounting sleeve into the first nozzle of the nozzle unit and is injected outward from the first nozzle of the nozzle unit.

8. The water sprayer in accordance with claim 2, further comprising a restoring spring mounted on the valve shaft and biased between the dividing disk of the valve shaft and the first side of the valve chamber of the control valve to push the dividing disk of the valve shaft toward the valve seat to open the connection between the first water conduit of the valve chamber and the water inlet channel of the control valve and to close the connection between the water inlet hole of the valve seat and the water inlet channel of the control valve.

9. The water sprayer in accordance with claim 8, wherein when the valve shaft is movable to the second position, a water pressure from the water inlet channel of the control valve overcomes an elastic force of the restoring spring, so that the water from the water inlet channel of the control valve is injected outwardly from the second nozzle of the nozzle unit constantly.

10. The water sprayer in accordance with claim 1, wherein the valve seat has an inside formed with a shaft hole to allow passage of the valve shaft.

11. The water sprayer in accordance with claim 10, wherein the water inlet hole of the valve seat is spaced from the first water conduit of the valve chamber and connected to the shaft hole.

12. The water sprayer in accordance with claim 1, wherein the valve seat has a peripheral wall formed with an annular seal portion rested on an open outer side of the valve chamber of the control valve to seal the valve chamber of the control valve.

13. The water sprayer in accordance with claim 1, wherein the control valve has a peripheral wall formed with a substantially spherical pivot base, and the control button has a first end formed with a substantially spherical pivot recess pivotally mounted on the pivot base of the control valve.

14. The water sprayer in accordance with claim 13, wherein the control button has a second end formed with a press portion rested on the second end of the valve shaft.

15. The water sprayer in accordance with claim 1, wherein the housing has a peripheral wall formed with an elongated slot to receive the control button.

16. The water sprayer in accordance with claim 1, wherein the first end of the housing is formed with a stepped through hole to retain the control valve.

17. The water sprayer in accordance with claim 1, wherein the second end of the housing is formed with an inner thread, and the nozzle unit has an outer thread screwed into the inner thread of the housing.

18. The water sprayer in accordance with claim 1, wherein the valve chamber of the control valve is extended in a direction perpendicular to an axial direction of the control valve and has a mediate portion connected to the water inlet channel of the control valve.

19. The water sprayer in accordance with claim 1, wherein the second nozzle of the nozzle unit is enclosed around and located outside of the first nozzle.

* * * * *